United States Patent [19]

Odermann

[11] 4,372,233

[45] Feb. 8, 1983

[54] SAFETY GENERAL PURPOSE PRESSER FOOT FOR STRAIGHT AND ZIG ZAG STITCHING

[75] Inventor: Charles R. Odermann, Montville, N.J.

[73] Assignee: The Singer Company, Stamford, Conn.

[21] Appl. No.: 233,799

[22] Filed: Feb. 12, 1981

[51] Int. Cl.[3] ..... D05B 29/06

[52] U.S. Cl. ..... 112/235

[58] Field of Search ..... 112/235, 236, 158 R, 112/163, 221, 167

[56] References Cited

U.S. PATENT DOCUMENTS

| | | | |
|---|---|---|---|
| 3,026,837 | 3/1962 | Enos . | |
| 3,081,721 | 3/1963 | Christiansen . | |
| 3,547,059 | 12/1970 | Dolney . | |
| 4,183,311 | 1/1980 | Knowles | 112/235 |
| 4,312,284 | 1/1982 | Adams et al. | 112/221 X |

FOREIGN PATENT DOCUMENTS

| | | |
|---|---|---|
| 41-898266 | 4/1966 | Japan . |
| 41-814533 | 11/1966 | Japan . |
| 54-105756 | 7/1979 | Japan . |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A zig zag sewing machine, wherein a needle bar having a basting position beyond its zig zagging range, is provided with a presser foot having therein an elongate opening which is defined to permit one needle of a twin needle device to pass therethrough without striking the foot upon descent of the needle bar of the machine from a basting position, and which has a beveled edge to interfere at one end of the opening with the other needle and deflect such other needle so that it can pass through the opening.

4 Claims, 8 Drawing Figures

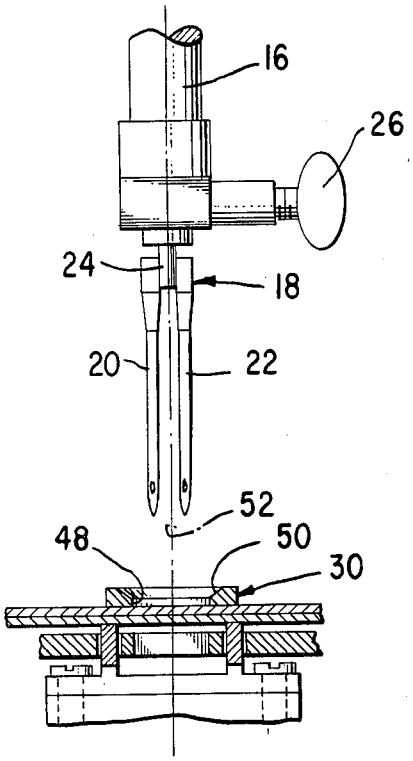
Fig. 5.
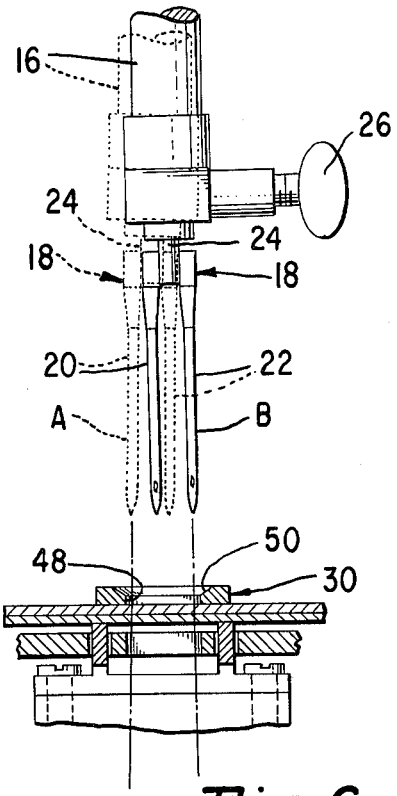
Fig. 6.
Fig. 7.
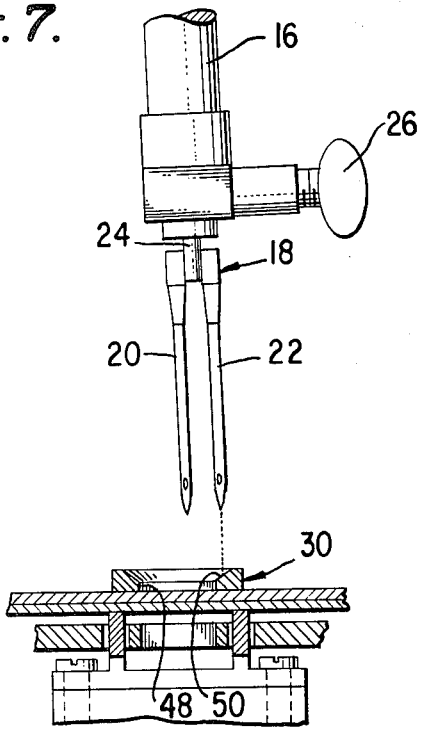
Fig. 8.
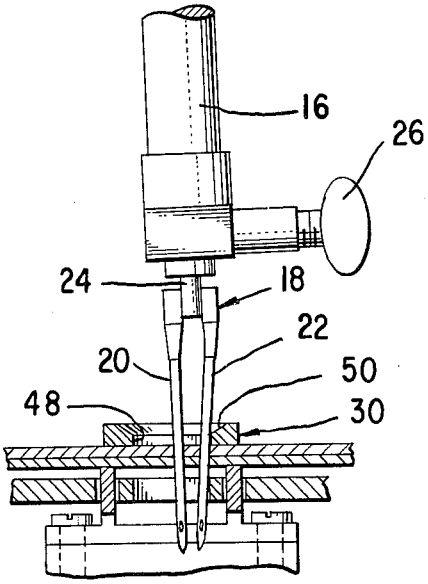

SAFETY GENERAL PURPOSE PRESSER FOOT FOR STRAIGHT AND ZIG ZAG STITCHING

DESCRIPTION

BACKGROUND OF THE INVENTION

1. Field of the Invention

The invention relates to zig zag sewing machines of a kind wherein a needle bar has a basting position beyond its zig zagging range.

2. Description of the Prior Art

Zig Zag sewing machines commonly include means for unlatching a needle bar from endwise reciprocating mechanisms and for holding such needle bar in a basting position beyond its zig zagging range when operating instructions to the machine call for a skipped stitch. It has been a problem with such machines that the holding mechanism has sometimes failed to retain the needle bar in the basting position. In order to prevent a needle bar from decending from the basting position with consequent damage to a sewing needle as upon impact with a presser foot, machines have been provided with internal camming means as shown, for example, in U.S. Pat. No. 3,559,601 of Edward Tullman for "Skip Stitch Mechanism for Household Sewing Machines" issued Feb. 21, 1971, and in the U.S. Patent application of Kenneth D. Adams and Gerald J. Creed for "Needle Bar Deflecting Arrangement for a Skip Stitch Sewing Machine Ser. No. 212,384 filed Dec. 3, 1980, U.S. Pat. No. 4,312,284 to urge the needle bar in a direction preventing the sewing needle from moving along a collision course with the presser foot. However, the use of such internal camming means has the disadvantage of adding both material and manufacturing costs to a machine.

It is a prime object of this invention to provide an improved simple inexpensive means effective to prevent damage to either a single needle or multi-needle sewing instrumentality as a consequence of downward movement thereof with a needle bar from a basting position of the needle bar outside its zig zagging range.

SUMMARY OF THE INVENTION

In accordance with the invention, a zig zag sewing machine, wherein a needle bar has a basting position outside its zig zag range, is provided on the presser bar with a presser foot that includes an elongate sole plate opening defined so that upon descent of the needle bar from a basting position with a sewing instrumentality having a pair of laterally spaced needles thereon, only the needle closest to a mid-line in the zig zagging range can pass through the opening without striking the sole plate. The opening includes an upper beveled edge which interfers at one end with the other needle and deflects such other needle so that it can pass through the opening. A conventional single needle passes through the sole plate opening without contacting the presser foot upon descent of the needle bar from the basting position. Because of the beveled edge in the sole plate opening there is more of the underside of the presser foot to contact and hold down material than would be the case if the opening permitted both needles of a double needle sewing instrumentality to pass through it without either contacting the sole plate.

Preferably the sole plate is formed with a slot connecting with the sole plate opening at the end opposite from the needle engageable end to provide a passage for thread through the side of the sole plate and into the elongate opening.

DESCRIPTION OF THE DRAWINGS

FIG. 5 is an elevational view, partially in section, indicating the relationship between the presser foot and the twin needle device when said twin needle device is in a central position;

FIG. 6 is a view similar to FIG. 5 showing the twin needle device in extreme zig zag positions;

FIG. 7 is a view similar to FIG. 5 showing the twin needle device in a basting position; and FIG. 8 is a view similar to FIG. 5 showing a needle of the twin needle device deflected.

DESCRIPTION OF THE PREFERRED EMBODIMENT OF THE INVENTION

Figure 1:
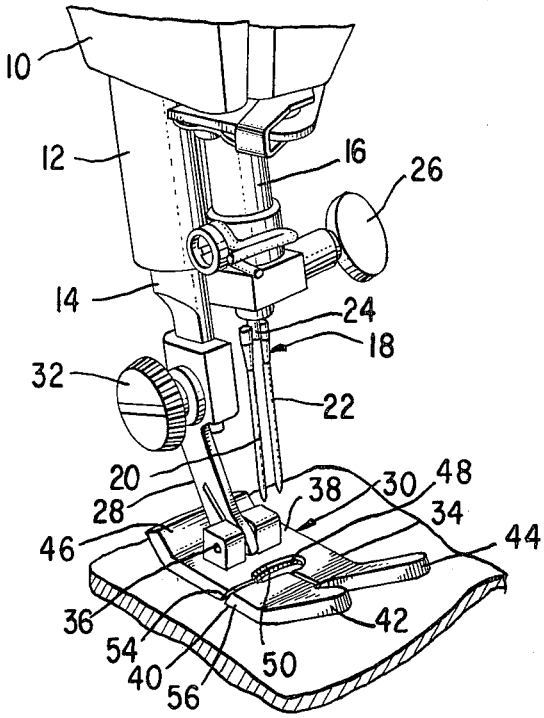
FIG. 1 is a perspective view of a portion of a sewing machine showing a twin needle device and presser foot according to the invention.
Figure 2:
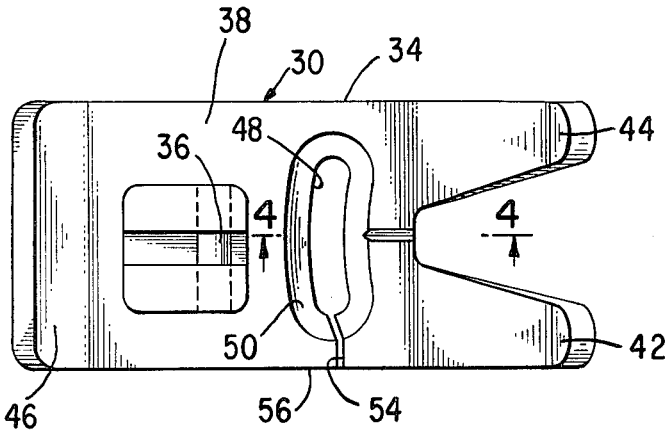
FIG. 2 is an enlarged top plan view of the presser foot.
Figure 3:
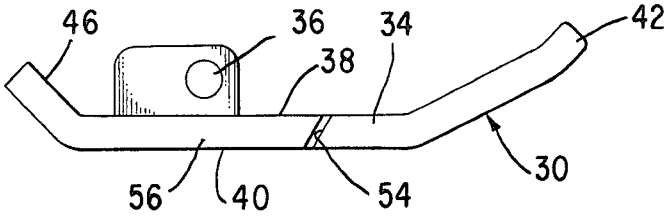
FIG. 3 is a side elevational view of the presser foot.
Figure 4:
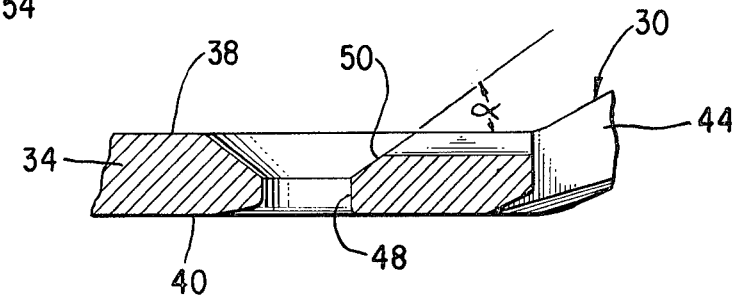
FIG. 4 is a sectional view taken on the plane of the line 4—4 of FIG. 2.

Referring to the drawing reference character 10 designates the head of a zig zag sewing machine provided with a bushing 12 in which a presser bar 14 is endwise slidably carried. The presser bar may be raised and lowered, as is conventional in the art by a manually operable lever (not shown). A needle bar 16 is journalled for endwise reciprocation and for vibration laterally of the line of stitch formation, or in other words, for zig zag movements in the head 10 by mechanism (not shown) in the conventional manner. Reference character 18 designates a twin needle device including a pair of laterally spaced needles 20 and 22 having therebetween a central stub shaft 24 which is shown secured in the needle bar 16 by a thumb screw 26.

The shank 28 of a presser foot 30 is secured to presser bar 14 by a screw 32. Presser foot 30 includes a sole plate 34 which is pivotally mounted at 36 on shank 28. The sole plate includes parallel top and bottom surfaces 38 and 40 respectively between toes 42 and 44 at one end of the foot, and a heel 46 at the opposite end.

An arcuate elongate opening 48 is provided in the sole plate 34 of the presser foot. Such elongate opening is formed with an upper planar beveled edge 50 extending at an angle $\alpha$ of not more than 45° relative to the planes of the sole plate surfaces 38 and 40 between the toes and heel of the presser foot. The length of opening 48 is such as to permit both needles 20 and 22 of twin needle device 18 to pass through the opening without contacting the sole plate 34 of the presser foot 30, whether the needle bar 16 is in a central position designated by mid-line 52 (See FIG. 5), or is at either end (A or B in FIG. 6) of the maximum zig zagging range through which the machine is capable of oscillating the twin needle device 18 for stitch formation as defined by conventional zig zag control means.

In FIG. 7, the needle bar is shown in a skip stitch or so called basting position which is a position on one side of the central position of the needle bar beyond the maximum zig zagging range. Basting stitch mechanism for positioning the needle bar to provide for skip stitching may be seen for example in U.S. Pat. No. 3,782,311 of Kenneth D. Adams for "Simplified Basting Stitch Mechanism" issued Jan. 1, 1974, and in U.S. Pat. No.

3,559,601 of Edward J. Tullman for "Skip Stitch Mechanism for Household Sewing Machines" issued Feb. 21, 1971. As may be seen from FIG. 7, the beveled edge 50 of opening 48 is such as to be in the path of the needle 22 and to engage it if the needle bar should accidentally descend from the basting position. The beveled edge 50 then serves to deflect this needle 22 farthest removed from mid-line 52 and cause it to pass without damage through the opening 48 as indicated in FIG. 8. As has been mentioned hereinbefore, the angle between the beveled edge 50 and planes of the sole plate surfaces 38 and 40 is not more than 45°. Such angle prevents an abrupt change in the direction of the needle 22 when deflected by the edge 50 and so avoids fracture of the needle shank. As may be seen in FIGS. 7 and 8, the position of needle 20 relative opening 48 in the basting position of the needle bar is such as to permit this needle to pass through the opening 48 without contacting the presser foot.

The presser foot 30 is formed with a threading slot 54. Such slot extends between one end of elongate opening 48 and side edge 56 of sole plate 34 to provide a passage for needle thread through the side of the sole plate 34 and into opening 48. The slot 54 is located in the sole plate at the one end of opening 48 opposite from the end where the beveled edge 50 may engage needle 22 upon descent of the needle bar 16 from a basting position, and interference of the slot with the deflection of the needle 22 is thereby avoided.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. In a zig zag sewing machine, a needle bar to which a sewing instrumentality with a pair of laterally spaced needles may be secured, a pressure bar, and a presser foot attached to the presser bar, the needle bar having a basting position beyond a lateral zig zagging range, said presser foot including a sole plate with a lateral elongate opening defined so that upon descent of the needle bar from the basting position only the needle closest to a mid-line in the zig zagging range can pass through the opening without striking the sole plate, the opening having an upper beveled edge to interfere at one end of the opening with the other needle and deflect such other needle so that it can pass through the opening.

2. The combination of claim 1 including a sole plate slot connecting with said opening at the end opposite from said one end to provide a passage for thread through the side of the sole plate and into the elongate opening.

3. The combination of claim 1 wherein the beveled edge is a planar surface.

4. The combination of claim 3 wherein the angle of the beveled edge relative to the top surface of the sole plate is not more than 45°.

* * * * *